US010122093B2

(12) United States Patent
Lee

(10) Patent No.: US 10,122,093 B2
(45) Date of Patent: Nov. 6, 2018

(54) DIPOLE ARRAY ANTENNA

(71) Applicant: Sercomm Corporation, Taipei (TW)

(72) Inventor: Pei-Ju Lee, Taipei (TW)

(73) Assignee: Sercomm Corporation, Taipei (TW)

( * ) Notice: Subject to any disclaimer, the term of this patent is extended or adjusted under 35 U.S.C. 154(b) by 0 days.

(21) Appl. No.: 15/694,864

(22) Filed: Sep. 4, 2017

(65) Prior Publication Data

US 2018/0226728 A1 Aug. 9, 2018

(30) Foreign Application Priority Data

Feb. 8, 2017 (CN) ..... 2017 2 0116674

(51) Int. Cl.

| | |
|---|---|
| ***H01Q 1/24*** | (2006.01) |
| ***H01Q 21/06*** | (2006.01) |
| ***H01Q 9/04*** | (2006.01) |
| ***H01Q 21/00*** | (2006.01) |
| ***H01Q 9/28*** | (2006.01) |

(52) U.S. Cl.

CPC ..... *H01Q 21/062* (2013.01); *H01Q 1/243* (2013.01); *H01Q 9/0421* (2013.01); *H01Q 9/285* (2013.01); *H01Q 21/0006* (2013.01)

(58) Field of Classification Search

CPC .... H01Q 21/062; H01Q 1/243; H01Q 9/0421; H01Q 9/285; H01Q 21/0006

See application file for complete search history.

(56) References Cited

U.S. PATENT DOCUMENTS

2016/0352019 A1* 12/2016 Hsu ..... H01Q 5/321
2018/0069291 A1* 3/2018 Davis ..... H01Q 1/2225

* cited by examiner

*Primary Examiner* — Dameon E Levi
*Assistant Examiner* — David Lotter
(74) *Attorney, Agent, or Firm* — Winston Hsu

(57) ABSTRACT

A dipole array antenna includes a plurality of antenna units including a first radiator and a second radiator. The first radiator includes first and second arms extending toward a first direction, the second radiator includes third and fourth arms extending toward an opposite of the first direction. A first current route of the first radiator includes a first direct trace extending from the first transmission line toward at least a quarter of the first arm and the second arm, and a first meandering trace extending from the first direct trace to at most three quarters of the first arm and the second arm. A second current route of the second radiator includes a second direct trace and a second meandering trace with similar layout as the first current route of the first radiator.

10 Claims, 5 Drawing Sheets

DIPOLE ARRAY ANTENNA

BACKGROUND OF THE INVENTION

1. Field of the Invention

The present invention relates to dipole array antenna, and more particularly, to a dipole array antenna having radiators with meandering trace.

2. Description of the Prior Art

Nowadays, the wireless communication product develops and expands, the size of the wireless communication product is limited in many aspects to satisfy the demand of light and compact appearance. Monopole antenna, Planar Inverted-F Antenna (PIFA) or dipole antenna is commonly used as the built-in antenna of the wireless communication product. However, the antenna performance is sensitive to environmental conditions, such as configurations of antenna space, circuit board and mechanical parts comprised in the product. The neighboring metal parts may impact the radiation pattern of the antenna, which leads to narrower operating bandwidth and lower radiation efficiency that is harmful to signal transmission and reception, and also reduces communication range. Therefore, how to design the built-in antenna with wider operating bandwidth and better radiation efficiency to improve communication range has become a challenge of the industry.

SUMMARY OF THE INVENTION

It is therefore an objective of the present invention to provide a dipole array antenna with meandering radiators to effectively reduce antenna size without antenna performance impact.

The present invention discloses a dipole array antenna for a wireless communication device, and includes a feeding terminal, a ground terminal, a first transmission line, a second transmission line, and a plurality of antenna units. The feeding terminal is used for feeding a radio-frequency signal. The first transmission line is electrically connected to the feeding terminal, and extends toward a first direction from the feeding terminal. The second transmission line is electrically connected to the feeding terminal, and extends toward the first direction from the feeding terminal. The plurality of antenna units is electrically connected to the first transmission line and the second transmission line, wherein each of the antenna units includes a first radiator and a second radiator. The first radiator is electrically connected to the first transmission line, and includes a first arm electrically connected to the first transmission line, and extending toward a first direction, and a second arm electrically connected to the first transmission line, and extending toward the first direction. The second radiator is electrically connected to the second transmission line, and includes a third arm electrically connected to the second transmission line, and extending toward an opposite of the first direction, and a fourth arm electrically connected to the second transmission line, and extending toward the opposite of the first direction. A first current route of the first radiator includes a first direct trace extending from the first transmission line toward at least a quarter of the first arm and the second arm, and a first meandering trace extending from the first direct trace to at most three quarters of the first arm and the second arm. A second current route of the second radiator includes a second direct trace extending from the second transmission line toward at least a quarter of the third arm and the fourth arm, and a second meandering trace extending from the second direct trace to at most three quarters of the third arm and the fourth arm.

In other words, in the dipole array antenna of the present invention, at least one sixteenth wavelength of each arm of the radiator of the antenna unit presents direct trace, and then the rest of each arm of the radiator of the antenna unit presents meandering trace. In such a structure, the energy of the radio-frequency signal can be effectively radiated and the antenna size can be reduced as well.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
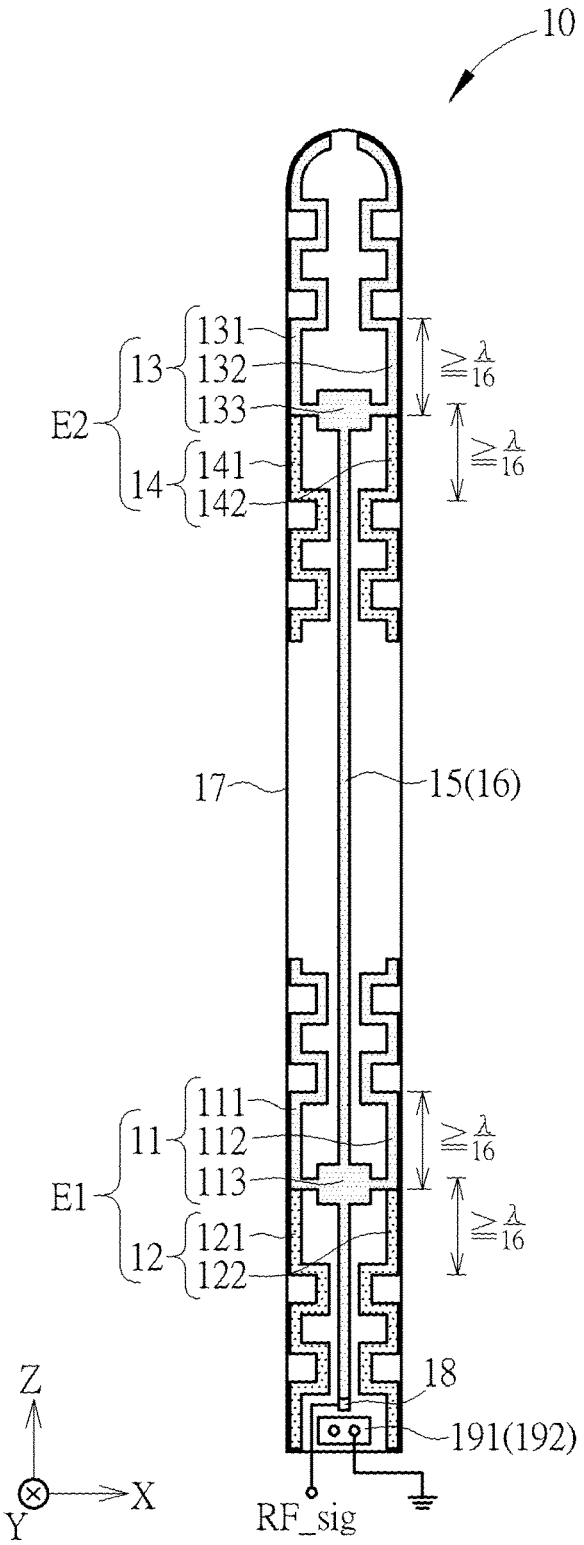
FIG. 1 illustrates a perspective view of an antenna according to an embodiment of the present invention.
Figure 2:
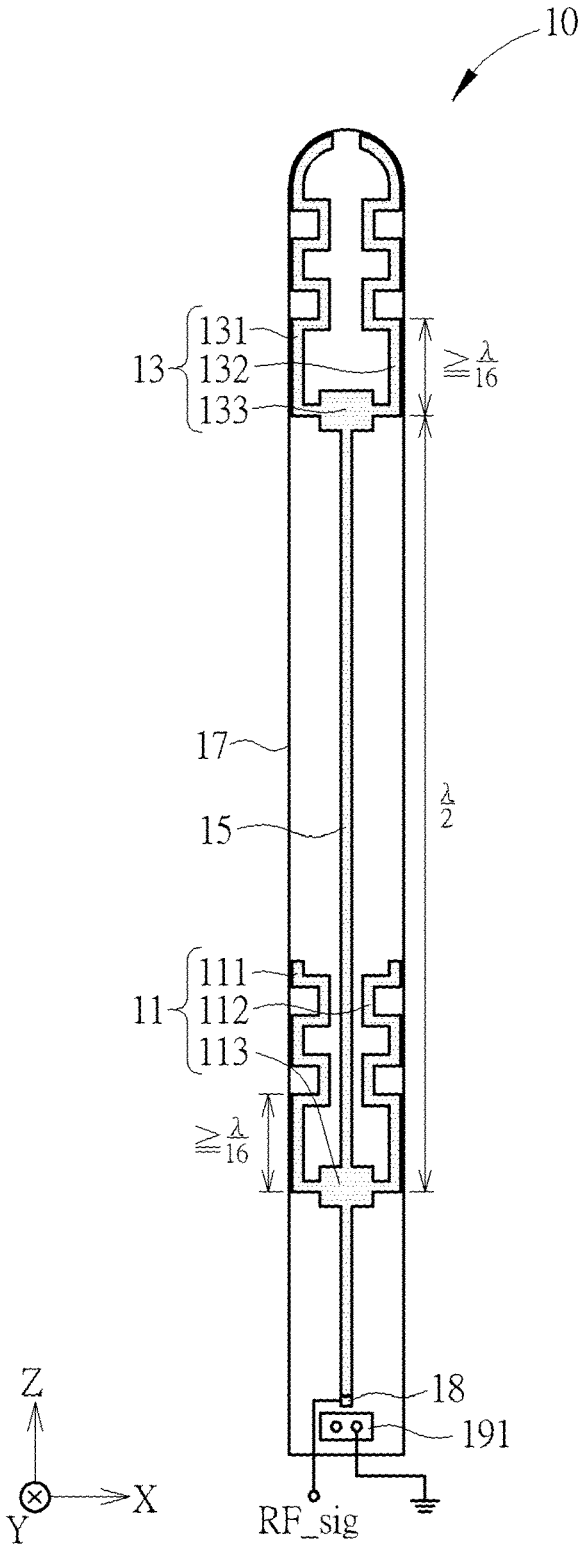
FIG. 2 illustrates a schematic diagram of the antenna in FIG. 1 from a first view angle (front view) of according to an embodiment of the present invention.
Figure 3:
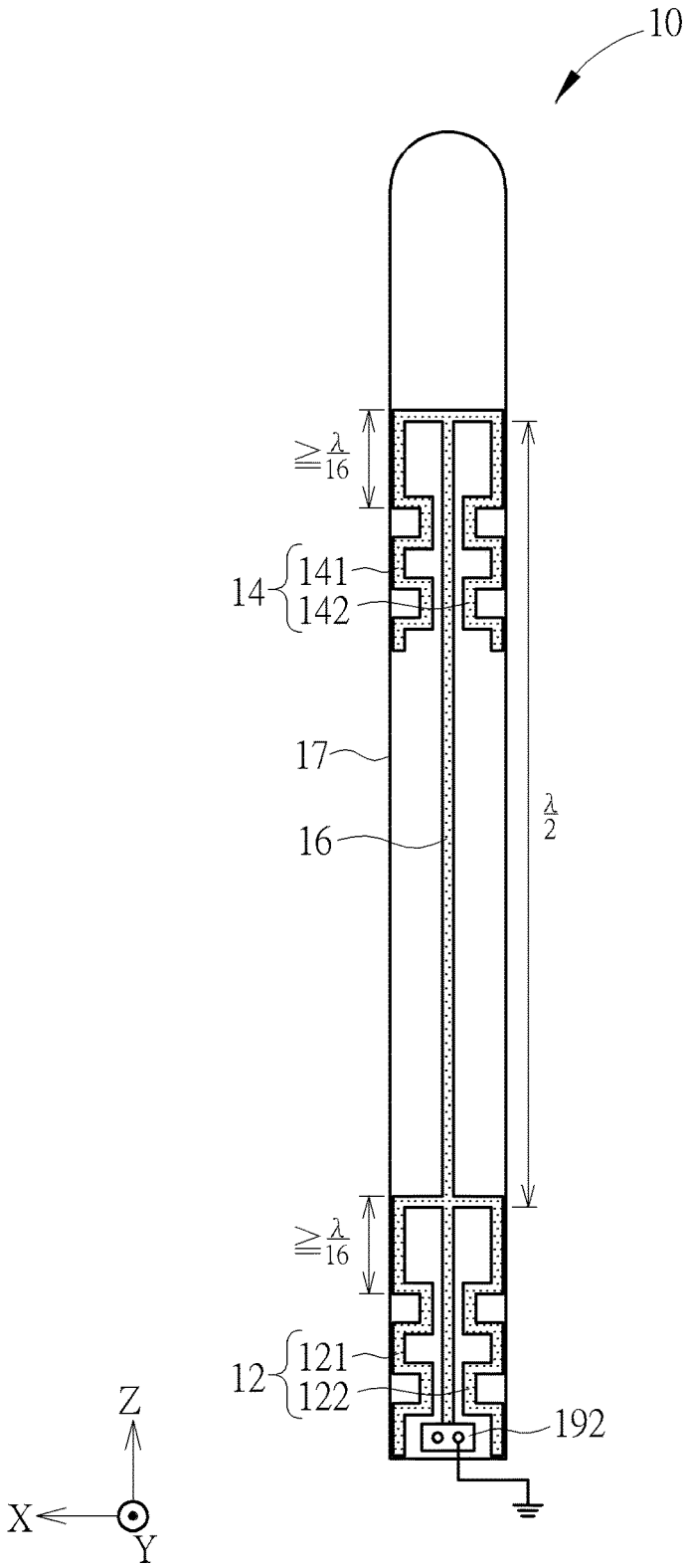
FIG. 3 illustrates a schematic diagram of the antenna in FIG. 1 from a second view angle (back view) according to an embodiment of the present invention.

FIG. 1 illustrates a perspective view of an antenna 10 according to an embodiment of the present invention. FIG. 2 and FIG. 3 illustrates a schematic diagram of the antenna 10 from a first view angle (front view) and a second view angle (back view), respectively. The antenna 10 may be used for a wireless communication device, such as a wireless dongle, Bluetooth communication device, smart phone, tablet computer, IP (Internet Protocol) Camera, Wireless Access Point wireless (WAP), personal computer, and so on. The wireless communication device may include a wireless communication module (not shown in FIG. 1 to FIG. 3) for generating a radio-frequency signal RF_sig to the antenna 10, and processing radio-frequency signals received by the antenna 10 to realize wireless communication.

As shown in FIG. 1, the antenna 10 may be a dipole array antenna and include a plurality of antenna units, each of the antenna units includes two dipole antennas (or radiators with dipole structure). In this embodiment, the antenna 10 includes antenna units E1 and E2, wherein the antenna unit E1 includes radiators 11 and 12, while the antenna unit E2 includes radiators 13 and 14. The antenna 10 further includes transmission lines 15 and 16, a substrate 17, a feeding terminal 18 and a ground terminal 192.

The radiator 11 includes arms 111 and 112, and a matching element 113. The matching element 113 is electrically connected to the transmission line 15 and the arms 111 and 112, for matching an input impedance of the radiator 11. Both the arms 111 and 112 are electrically connected to the matching element 113, extend toward +Z direction from the matching element 113, and symmetric about an extension line of the transmission line 15. In detail, the arm 111 presents an L shape, while the arm 112 presents a reversed-L shape. The arms 111 and 112 extend from the transmission line 15 if the matching element 113 is removed. The length of the current routes of the arms 111 and 112 (i.e., the length from the matching element 113 or the transmission line 15 extending toward the open terminal of the arms 111 and 112, respectively) may be a quarter wavelength of the radio-frequency signal RF_sig. The current route of the arms 111 and 112 from the matching element 113 or the transmission line 15 extending to at least one sixteenth wavelengths (λ/16) of the radio-frequency signal RF_sig may present direct trace, and the rest of the current route extending to the open terminal may present meandering trace. In other words, in the current route of the arms 111 and 112, at least a quarter of the current route presents direct trace, and at most three quarters of the current route present meandering trace, which may effectively reduce antenna size without antenna performance impact.

The radiator 12 includes arms 121 and 122. Both the arms 121 and 122 are electrically connected to the transmission line 16, respectively extend toward −Z direction from the transmission line 16, and symmetric about an extension line of the transmission line 16. In detail, the arm 121 presents an inverted-L shape, while the arm 122 presents an inverted-and-reversed-L shape. The length of the current routes of the arms 121 and 122 (i.e., the length from the transmission line 16 extending toward the open terminal of the arms 121 and 122, respectively) may be a quarter wavelength of the radio-frequency signal RF_sig. The current route of the arms 121 and 122 from the transmission line 16 extending to at least one sixteenth wavelengths (λ/16) of the radio-frequency signal RF_sig may present direct trace, and the rest of the current route extending to the open terminal may present meandering trace. In other words, in the current route of the arms 121 and 122, at least a quarter of the current route presents direct trace, and at most three quarters of the current route present meandering trace, which may effectively reduce antenna size without antenna performance impact. Of course, another matching element similar to the matching element 113 may be disposed at where the arms 121 and 122 are connected to the transmission line 16.

Similarly, the radiator 13 includes arms 131 and 132, and a matching element 133. The matching element 133 is electrically connected to the transmission line 15 and the arms 131 and 132, for matching an input impedance of the radiator 13. Both the arms 131 and 132 are electrically connected to the matching element 133, extend toward +Z direction from the matching element 133, and symmetric about an extension line of the transmission line 15. In detail, the arm 131 presents an L shape, while the arm 132 presents a reversed-L shape. The arms 131 and 132 extend from the transmission line 15 if the matching element 133 is removed. The length of the current routes of the arms 131 and 132 (i.e., the length from the matching element 133 or the transmission line 15 extending toward the open terminal of the arms 131 and 132, respectively) may be a quarter wavelength of the radio-frequency signal RF_sig. The current route of the arms 131 and 132 from the matching element 133 or the transmission line 15 extending to at least one sixteenth wavelengths (λ/16) of the radio-frequency signal RF_sig may present direct trace, and the rest of the current route extending to the open terminal may present meandering trace. In one embodiment, the open terminal of the current route of the arms 131 and 132 presents arc shape to adapt to appearance design of the wireless communication device.

The radiator 14 includes arms 141 and 142. Both the arms 141 and 142 are electrically connected to the transmission line 16, respectively extend toward −Z direction from the transmission line 16, and symmetric about the extension line of the transmission line 16. In detail, the arm 141 presents inverted-L shape, while the arm 142 presents inverted-and-reversed-L shape. The length of the current routes of the arms 141 and 142 (i.e., the length from the transmission line 16 extending toward the open terminal of the arms 141 and 142, respectively) may be a quarter wavelength of the radio-frequency signal RF_sig. The current route of the arms 141 and 142 from the transmission line 16 extending to at least one sixteenth wavelength of the radio-frequency signal RF_sig may present direct trace, and the rest of the current route extending to the open terminal may present meandering trace. Of course, another matching element similar to the matching element 133 may be disposed at where the arms 141 and 142 are connected to the transmission line 16.

In detail, in the antenna unit E1, the arms 111 and 121 form a dipole antenna, and the arms 112 and 122 form another dipole antenna. Similarly, in the antenna unit E2, the arms 131 and 141 form a dipole antenna, and the arms 132 and 142 form another dipole antenna. Since current intensity of the dipole antenna (or arms with dipole structure) is described by a function of sine wave, wherein the maximum of the current intensity gradually decreases from where the arm and the transmission line are connected to the open terminal of the arm. In addition, the shape of the arm associates with the radiation impedance and radiation energy, wherein the arm with direct trace has a lower impedance and a higher radiation energy, and it requires a greater antenna space; while the arm with meandering trace has a higher radiation impedance and a lower radiation energy, and it requires a smaller antenna space. In order to effectively reduce antenna size without antenna performance impact, in the arms of the radiator of the antenna unit of the present invention, at least λ/16 of the arms of the radiator presents direct trace, and then the rest of the arms of the radiator presents meandering trace. In such a structure, the energy of the radio-frequency signal can be effectively radiated and the antenna size can be reduced as well.

As shown in FIG. 2, the substrate 17 includes a first layer (e.g., top surface), wherein an auxiliary ground terminal 191, the radiators 11 and 13, the transmission line 15 and a feeding terminal 18 are formed in the first layer of the substrate 17. The feeding terminal 18 is electrically connected to the transmission line 15, for feeding the radio-frequency signal RF_sig. The transmission line 15 is electrically connected to the feeding terminal 18 and the radiators 11 and 13, extends toward the +Z direction from the feeding terminal 18, for transmitting the radio-frequency signal RF_sig to the radiators 11 and 13. In one embodiment, the radiator 11 is distance from the radiator 13 by a half wavelength of the radio-frequency signal RF_sig (or, twice the arm length) along the Z direction, which makes the radio-frequency signal RF_sig to be in-phase when respectively arriving at the radiators 11 and 13. As a result, the radiation pattern of the two antenna units E1 and E2 may be constructively superimposed by the same phase and amplitude, so as to improve overall antenna efficiency. For example, the length from where the transmission line 15 is connected to the matching element 113 extending toward the matching element 133 may be a half wavelength of the radio-frequency signal RF_sig (or, twice the arm length).

As shown in FIG. 3, the substrate 17 further includes a second layer (e.g., bottom surface), wherein the ground terminal 192, the radiators 12 and 14 and the transmission line 16 are formed in the second layer of the substrate 17. The ground terminal 192 is electrically connected to the transmission line 16. The transmission line 16 is electrically connected to the ground terminal 192 and the radiators 12 and 14, and extends toward the +Z direction from the ground terminal 192. In one embodiment, the radiator 12 is distant from the radiator 14 by a half wavelength of the radio-frequency signal RF_sig (or, twice the arm length) along the Z direction, which makes the radio-frequency signal RF_sig to be in-phase when respectively arriving at the radiators 12 and 14. As a result, the radiation pattern of the two antenna units E1 and E2 may be constructively superimposed by the same phase and amplitude, so as to improve overall antenna efficiency. For example, the length from where the transmission line 16 is connected to where the arms 121 and 122 are connected extending toward where the arm 141 and 142 are connected may be a half wavelength of the radio-frequency signal RF_sig (or, twice the arm length).

In one embodiment, the substrate 17 further includes at least one conductive via, wherein the conductive via penetrates the substrate 17 to electrically connect the ground terminal 192 and the auxiliary ground terminal 191. In addition, the antenna 10 further includes a radio-frequency connector (not shown) disposed in the first layer of the substrate 17, electrically connected to the feeding terminal 18, the ground terminal 192 and the auxiliary ground terminal 191, for transmitting the radio-frequency signal RF_sig to the feeding terminal 18. In one embodiment, the radio-frequency connector may be a U.FL connector for connecting a coaxial cable (e.g., IPEX transmission line), to electrically connect an inner core of the coaxial cable to the feeding terminal 18, and electrically connect an outer woven shield of the coaxial cable to the ground terminal 192 and the auxiliary ground terminal 191.

Under the structure of the antenna in FIG. 1 to FIG. 3, the dipole array antenna 10 of the present invention includes the in-phase antenna units E1 and E2 cascaded along the Z direction, wherein in the arms of the radiator of each of the antenna unit, at least $\lambda/16$ of the arms of the radiator presents direct trace, and then the rest of the arms of the radiator presents meandering trace. In such a structure, the energy of the radio-frequency signal can be effectively radiated and the antenna size can be reduced as well. In addition, a horizontal radiation pattern of the dipole array the antenna 10 in the XY plane is omni-directional, which is beneficial for omni-directional signal reception and transmission.

Noticeably, those skilled in the art may make modifications and alterations according to the embodiments of the present invention, which is not limited. In one embodiment, the operating frequency of the radio-frequency signal RF_sig may range from 2.4 GHz-2.5 GHz to adapt to 2.4 G band standardized by wireless local area network (WLAN), WiFi and Bluetooth wireless communication technology, wherein the size of the antenna 10 may be 99.5 mm*9 mm*0.6 mm. In another embodiments, by adjusting length and shape of the elements included in may adjust matching mode and operating frequency of the antenna 10, so as to adapt to another wireless communication technology, such as 5 G band (5.1 GHz-5.8 GHz) standardized by WLAN, WiFi and Bluetooth wireless communication technology, third generation mobile communication technology, Long Term Evolution (LTE), Zigbee, Z-wave, Digital Enhanced Cordless Telecommunications (DECT), and so on.

Figure 4:
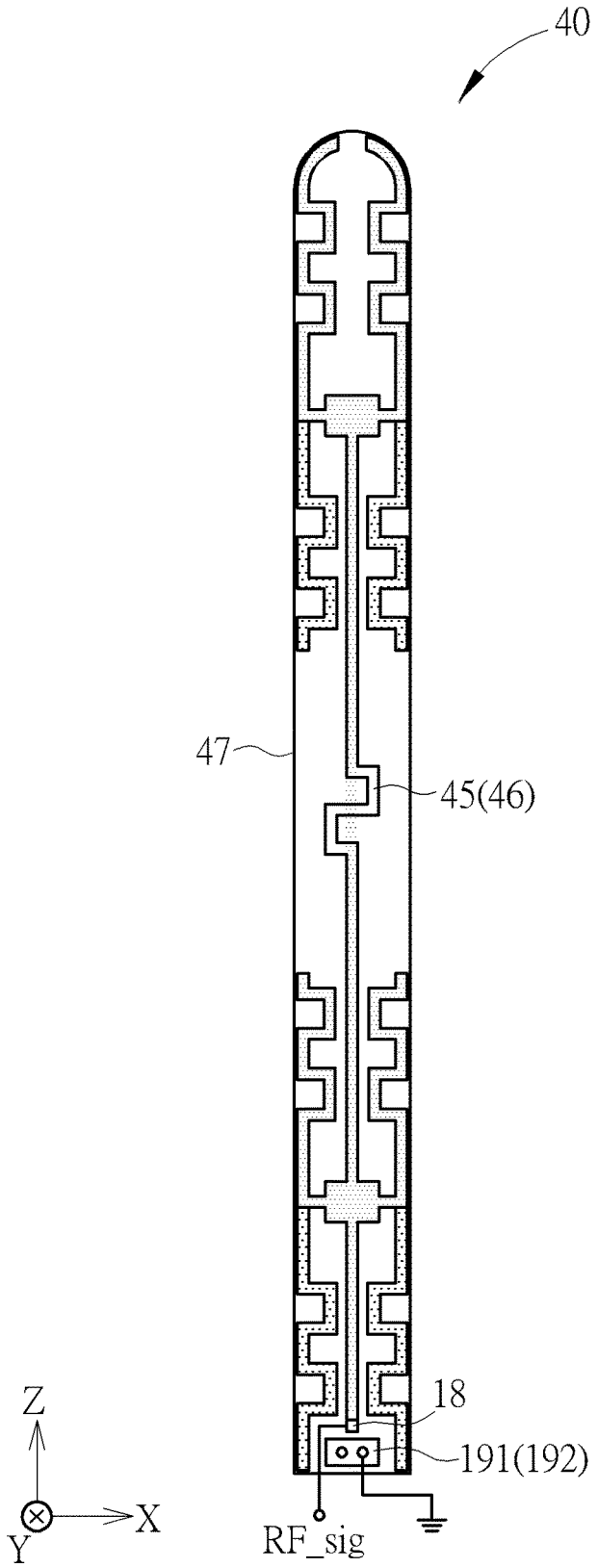
FIG. 4 illustrates a perspective view of an antenna according to another embodiment of the present invention.

In one embodiment, a portion of the transmission line may be with meandering trace to further reduce the antenna size. FIG. 4 illustrates a perspective view of an antenna 40 according to another embodiment of the present invention. The antenna 40 includes transmission lines 45 and 46, and a substrate 47, wherein the transmission line 45 is formed in a top surface of the substrate 47, while the transmission line 46 is formed in a bottom surface of the substrate 47. The structures of the antennas 40 and 10 are similar, a portion of the transmission lines 45 and 46 are with meandering trace to further reduce the size of the antenna 40 along the Z direction. In one embodiment, a portion of the transmission lines 45 and 46 with meandering trace is disposed in the middle of the two antenna units E1 and E2, which avoids the input impedance of the radiator from being interfered by the transmission line.

Figure 5:
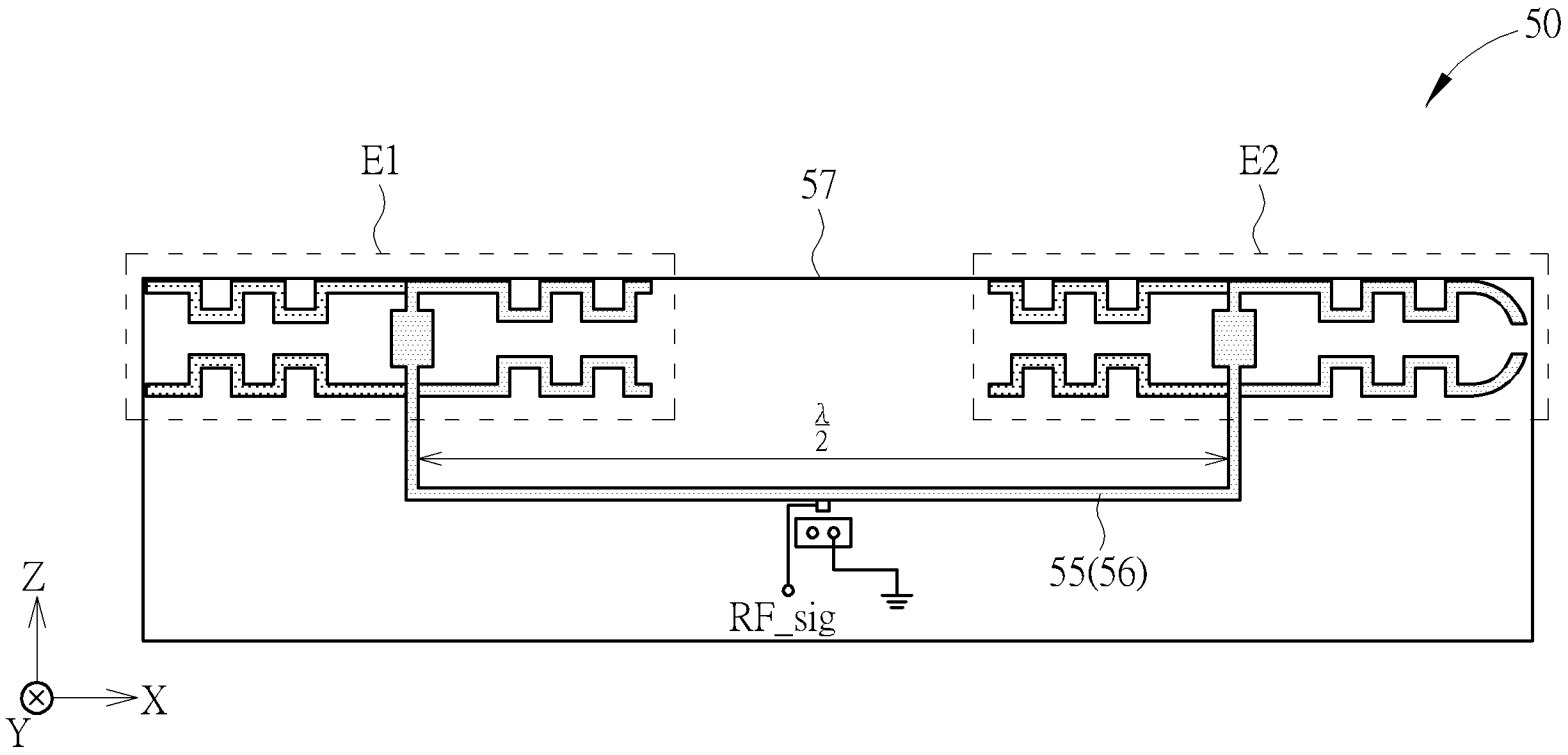
FIG. 5 illustrates a perspective view of an antenna according to another embodiment of the present invention.

In addition, the dipole array the antennas 10 and 40 in FIG. 1 and FIG. 4 utilize a serial feeding network to feed the radio-frequency signal, which is not limited. The dipole array antenna may utilize another feeding network (e.g., parallel feeding network) to feed the radio-frequency signal. FIG. 5 illustrates a perspective view of an antenna 50 according to another embodiment of the present invention. The antenna 50 includes the antenna units E1 and E2, transmission lines 55 and 56 and a substrate 57, wherein the transmission line 55 is formed in a top surface of the substrate 57, while transmission line 56 is formed in a bottom surface of the substrate 57. The structures of the antennas 50 and 10 are similar, the transmission lines 55 and 56 utilize the parallel feeding network to feed the radio-frequency signal. The length of the transmission lines 55 and 56 along the X direction is a half wavelength of the radio-frequency signal RF_sig (or, twice the arm length). As a result, the radiation pattern of the two antenna units E1 and E2 may be constructively superimposed by the same phase and amplitude, so as to improve overall antenna efficiency.

In one embodiment, the feeding network may be formed in the printed circuit board based on co-planar strip (CPS) transmission line.

To sum up, in the dipole array antenna of the present invention, at least one sixteenth wavelength of the arms of the radiator of the antenna unit presents direct traces, and then the rest of the arms of the radiator of the antenna unit presents meandering traces. In such a structure, the energy of the radio-frequency signal can be effectively radiated and the antenna size can be reduced as well.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A dipole array antenna, comprising:

a feeding terminal for feeding a radio-frequency signal;

a ground terminal;

a first transmission line electrically connected to the feeding terminal;

a second transmission line electrically connected to the ground terminal; and a plurality of antenna units, wherein each of the antenna units comprises:

a first radiator electrically connected to the first transmission line, and comprising:

a first arm electrically connected to the first transmission line, and extending toward a first direction; and a second arm electrically connected to the first transmission line, and extending toward the first direction; and a second radiator electrically connected to the second transmission line, and comprising:

a third arm electrically connected to the second transmission line, and extending toward an opposite of the first direction; and a fourth arm electrically connected to the second transmission line, and extending toward the opposite of the first direction;

wherein a first current route of the first radiator includes a first direct trace and a first meandering trace, the first direct trace extends from the first transmission line toward at least a quarter of the first arm and the second arm, and the first meandering trace extends from the first direct trace to at most three quarters of the first arm and the second arm;

wherein a second current route of the second radiator includes a second direct trace and a second meandering trace, the second direct trace extends from the second transmission line toward at least a quarter of the third arm and the fourth arm, and the second meandering trace extends from the second direct trace to at most three quarters of the third arm and the fourth arm.

2. The dipole array antenna of claim 1, further comprising:

a substrate, comprising:

a first layer, wherein the feeding terminal, the first transmission line and the first radiator are formed in the first layer; and a second layer, wherein the ground terminal, the second transmission line and the second radiator are formed in the second layer.

3. The dipole array antenna of claim 2, wherein the first layer and the second layer are opposite surfaces of the substrate, the first layer further comprises a auxiliary ground terminal, the substrate further comprises at least one conductive via that penetrates the substrate to electrically connect the ground terminal and the auxiliary ground terminal.

4. The dipole array antenna of claim 1, wherein the first transmission line and the second transmission line form a serial feeding network, the first transmission line extends from the feeding terminal toward the first direction, the second transmission line extends from the ground terminal toward the first direction, and the first transmission line and the second transmission line connect the plurality of antenna units along the first direction.

5. The dipole array antenna of claim 1, wherein the first transmission line and the second transmission line form a parallel feeding network, the first transmission line and the second transmission line extend from the feeding terminal along the first direction, and then extend to the plurality of antenna units along the second direction, wherein the first direction is perpendicular to the second direction.

6. The dipole array antenna of claim 1, wherein two of the plurality of antenna units are distant from each other along the first direction twice length of the first arm, and the length of the first arm is a quarter wavelength of the radio-frequency signal.

7. The dipole array antenna of claim 1, wherein open terminals of the first arm and the second arm of at least one of the plurality of antenna units present an arc shape.

8. The dipole array antenna of claim 1, wherein the first arm and the second arm are symmetric about an extension line of the first transmission line, and the third arm and the fourth arm are symmetric about an extension line of the second transmission line.

9. The dipole array antenna of claim 1, wherein the first arm presents an L shape, and the second arm presents a reversed-L shape, the third arm presents an inverted-L shape, and the fourth arm presents an inverted-and-reversed-L shape.

10. The dipole array antenna of claim 1, wherein the first radiator further comprises a matching element, electrically connected to the first transmission line, the first arm and the second arm, for matching an input impedance of the first radiator.

* * * * *